US007510162B2

(12) United States Patent
Lackey et al.

(10) Patent No.: US 7,510,162 B2
(45) Date of Patent: Mar. 31, 2009

(54) TWO PIECE MAILBOX SUPPORT

(75) Inventors: Robert W. Lackey, Hickory, NC (US); Robert C. Beckmann, Vail, NC (US)

(73) Assignee: RWL Corporation, Hickory, NC (US)

( * ) Notice: Subject to any disclaimer, the term of this patent is extended or adjusted under 35 U.S.C. 154(b) by 677 days.

(21) Appl. No.: 11/052,648

(22) Filed: Feb. 7, 2005

(65) Prior Publication Data

US 2006/0175480 A1 Aug. 10, 2006

(51) Int. Cl.
*A47G 29/12* (2006.01)

(52) U.S. Cl. ..... 248/524; 248/507; 248/156; 232/39

(58) Field of Classification Search ..... 248/507, 248/508, 156, 545, 218.4, 219.1, 219.3, 219.4, 248/228.5, 228.1, 524, 525; 232/39, 17, 232/16; 403/310–312, 344
See application file for complete search history.

(56) References Cited

U.S. PATENT DOCUMENTS 4,923,623 A * 5/1990 Coffindaffer ..... 510/513
5,060,908 A * 10/1991 Sofy ..... 248/545
5,184,911 A * 2/1993 Wu ..... 403/385
5,212,898 A * 5/1993 Dinan et al. ..... 40/607.12
5,634,620 A * 6/1997 Verot ..... 248/229.14
5,661,946 A * 9/1997 Davis ..... 52/736.1
5,785,447 A * 7/1998 Fonti et al. ..... 403/49
6,439,744 B1 * 8/2002 Chanslor ..... 362/249
7,090,118 B2 * 8/2006 Lackey et al. ..... 232/39

* cited by examiner

*Primary Examiner*—Korie H. Chan
*Assistant Examiner*—Steven Marsh
(74) *Attorney, Agent, or Firm*—Charles L. Schwab; Nexsen Pruet, LLC

(57) ABSTRACT

A two piece plastic support is provided for a plastic mailbox, which upon installation surrounds a support post mounted in the ground. The two pieces are substantially reverse images of one another with confronting post receiving channels on their inward sides. The channels are dimensioned to accommodate warped or slightly over size posts. Corresponding sides of the channels have protuberances, which stabilize the post within the channel. Abutting pockets in the inner and outer walls of each of the pieces aligned openings for fasteners.

5 Claims, 4 Drawing Sheets

TWO PIECE MAILBOX SUPPORT

BACKGROUND OF THE INVENTION

The plastic support components for a plastic mailbox are normally secured by releasable fasteners to an upright post such as a four by four pressure treated wood post. Such posts are sturdy, resist decay and are reasonable in cost; however, they often have imperfections in dimension due to warpage and rough cutting. The interior pocket or pockets of the plastic support post must be made sufficiently large to accommodate the deviations in post dimensions; however, this can result in a loose fit for some installations. Even though the plastic parts of the support are secured by fasteners to the wood post, the lack of support contact otherwise between the post and the plastic support components may allow the mailbox to move, thereby producing undesired instability. Some prior constructed plastic mailboxes use a plastic support, which confronts three of the four sides of a square section wooden post with one side of the plastic support secured to the post. A separate piece of flat plastic is provided for attachment to the fourth side to improve the appearance of the mailbox with attendant increase in cost.

BRIEF SUMMARY OF THE INVENTION

A two piece double walled plastic support is provided for a plastic mailbox, which is adapted for securement to a wooden post set in the ground. The two pieces of the plastic support have vertically elongated facing channels for encasing a wooden mounting post when placed on its laterally opposite sides. The width of the channels are amply dimensioned to accommodate rough sawed four by four wood posts, including those that have been pressure treated with preservative; however, near the midpoint in the length of each of the channels a protrusion is provided to compensate for any looseness that might result when the clearance is excessive.

BRIEF DESCRIPTION OF THE DRAWINGS

One embodiment of the invention is illustrated in the accompanying drawings in which.

DETAILED DESCRIPTION OF THE INVENTION

Figure 1:
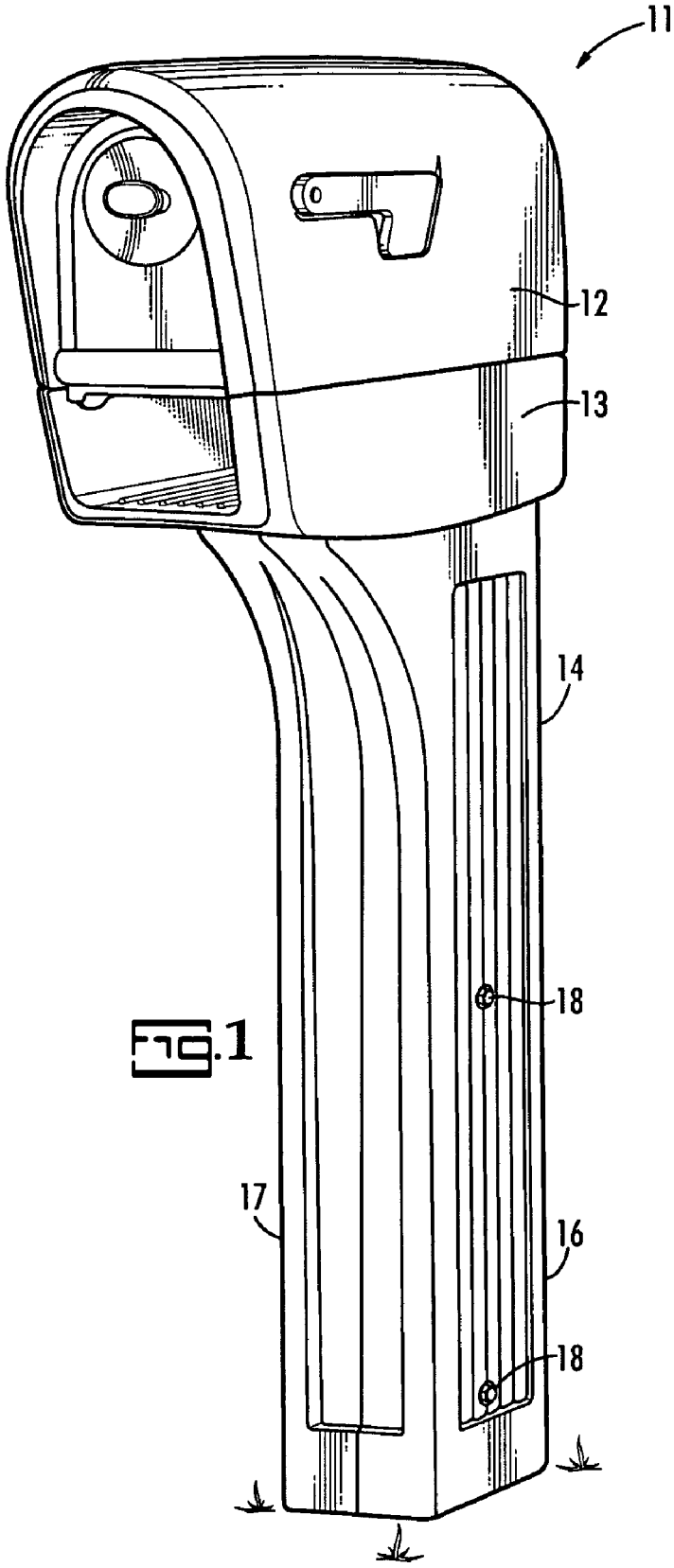
FIG. 1 is a perspective view of a plastic mailbox incorporating the invention.

The double walled plastic mailbox 11 shown in FIG. 1 includes a postal box 12, an open-ended newspaper box 13 secured to and disposed beneath the postal box 12 and an upright two piece support 14 having a double wall right piece 16 and double wall left piece 17. At installation, the right and left pieces 16, 17 are secured by screws 18 to an upright wood post 19 set in the ground.

Figure 2:
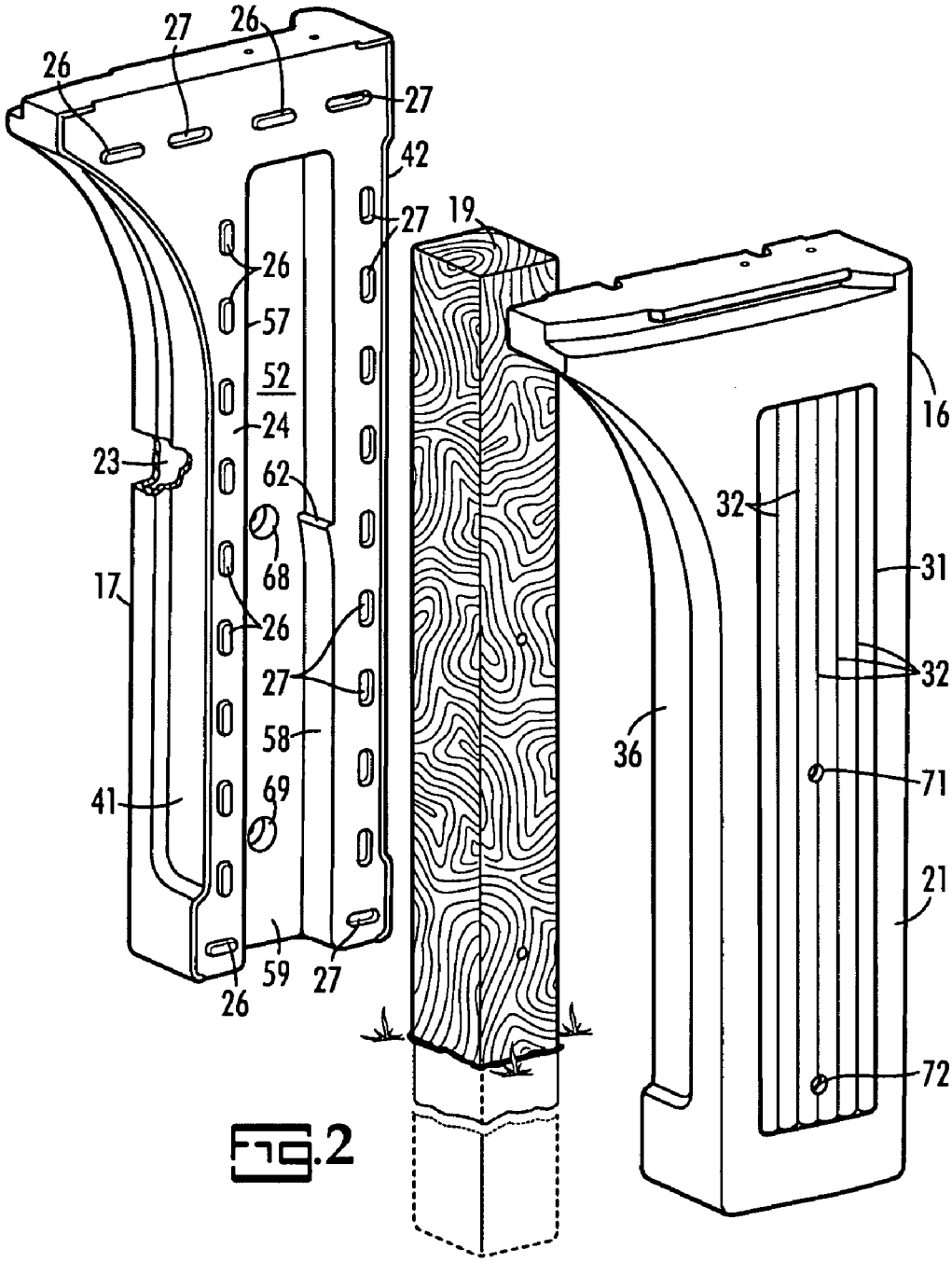
FIG. 2 is a perspective view of the right and left pieces of a plastic mailbox support exploded from a wooden post.
Figure 5:
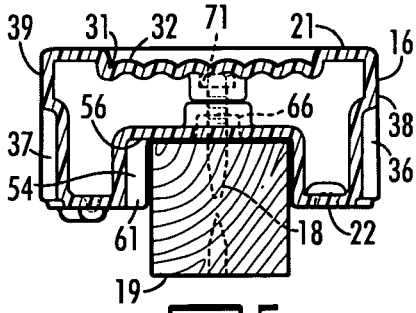
FIG. 5 is a section taken on the line 5-5 in FIG. 4.
Figure 6:
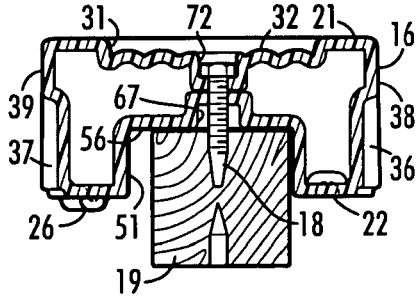
FIG. 6 is a section taken on line 6-6 in FIG. 4.

As shown in FIGS. 5 and 6, the right piece 16 of the support 14 has an outer wall 21 and an inner wall 22 and, as shown in FIG. 2, the left piece has an outer wall 23 and an inner wall 24. Complimentary or mating studs 26 and sockets 27 are formed on confronting sides of the inner walls 22, 24 and are in mating registration when the pieces are installed on the post 19. The right and left pieces 16, 17 are reverse images of one another except for the studs and sockets.

The outer walls 21, 23 have a plurality of parallel vertically extending indentations with vertical ribs. The vertical ribs reinforce the outer walls 21, 23. The indentations extend from near the bottom to near the top of the outer walls 21, 23 of the support pieces 16, 17. FIGS. 1, 2, 5 and 6 show the vertically extending indentation 31 and the vertical ribs 32 in the right piece 16. Vertically extending indentations 36, 37 without ribs are formed in the front wall 38 and the rear wall 39 of the right piece 16. The indentations 36, 37 also extend vertically from near the bottom to near the top of the support piece 16. In a similar manner indentations 41, 42 are formed on the front wall and rear wall of the left support piece 17.

Figure 3:
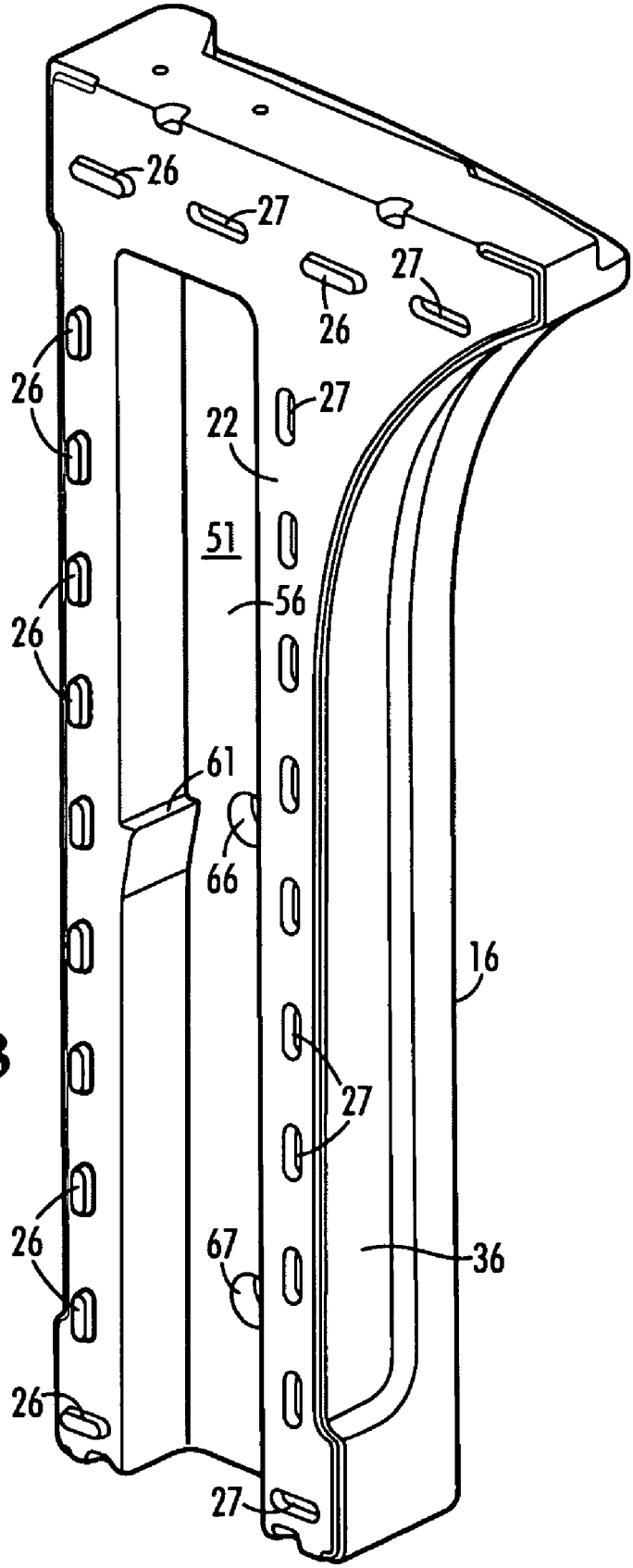
FIG. 3 is a perspective view of the right piece of the plastic mailbox support.
Figure 4:
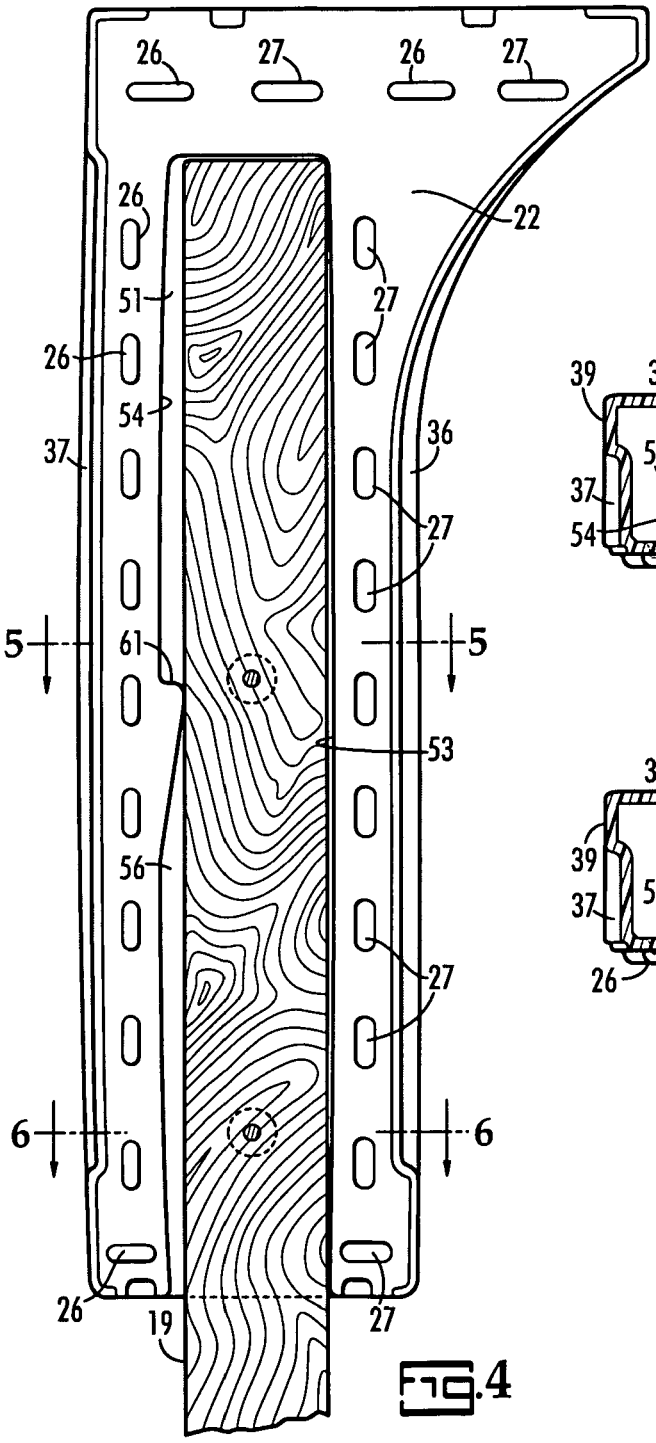
FIG. 4 is a side view of the post and the right piece of the plastic mailbox support.

As shown in FIGS. 2-6, confronting channels 51, 52 are formed in the inner walls 22, 24 of the right and left support pieces 16, 17, respectively, to receive the mounting post 19. Channel 51 in the right piece 16 is defined by a vertically extending front side 53, a vertically extending rear side 54 and a vertically extending bottom or lateral side 56. Channel 52 is defined by a vertically extending front side 57, a vertically extending rear side 58 and a vertically extending bottom or lateral side 59. The double wall construction of the support pieces 16, 17 produces a strong support 14 and its strength is augmented by the structure of the channels 51, 52. The channels 51, 52 are dimensioned to be sufficiently large to accommodate pressure treated four by four rough sawed wooden posts. The post 19 may be warped or bowed or otherwise at variance from specified or normal dimensions. In order to prevent the plastic support 14 from being too loose on the post 19, forwardly extending protuberances 61, 62 are formed on the rear sides 54, 58, respectively, at or near their midpoints. As shown in FIGS. 4, 5 and 6 the protuberances 61, 62 tend to force the post 19 against the front sides 53, 57 of the channels 51, 52.

As shown in FIGS. 3, 5 and 6, a pair of pockets 66, 67 are formed in the lateral side 56 of the channel 51 and, as shown in FIG. 2, similar pockets 68, 69 are formed in the lateral side 59 of channel 52. Each of the pockets 66, 67, 68, 69 has an opening in its flat bottom through which a screw 18 extends. Pockets 71, 72 are formed in the outer wall 21 of the support piece 16 and the bottoms of the pockets 71, 72 abut the bottoms of the pockets 66, 67, respectively. Openings for the screws 18 are formed in the bottoms of the pockets 71, 72 in alignment with openings in the pockets 66, 67 and the heads of the screws 18 are disposed within the pockets 71, 72. The abutting pockets 71, 66 and 72, 67 have annular side walls and flat bottom walls and serve to increase the rigidity and strength of the support piece 16. In a like manner the support piece 17 is provided with similar abutting pockets with openings for screws 18. The abutting pockets of the support pieces 16, 17 provide reinforcement for those components of the mailbox.

What is claimed is:

1. A plastic support for a plastic mailbox adapted to mount on a square section post set in the ground, comprising:

first and second vertically extending pieces each having vertically extending outer, inner, front and rear walls, said inner walls presenting confronting channels respectively, extending vertically upward from the lower ends of said pieces, each of said channels having a front side, a rear side and a bottom side, and a protuberance integrally formed on and near the mid point of each of said rear sides of said channels extending into the associated channel, said protuberances being in abutment with and tending to urge a post inserted into said channels toward said front sides of said channels.

2. The plastic support of claim 1 having complimentary studs and sockets formed on said inner walls of said pieces which are in mating registration when said pieces are installed on said post.

3. A plastic support for a plastic mailbox adapted to mount on a square section post set in the ground, comprising:

first and second vertically extending pieces each having vertically extending outer, inner, front and rear walls, said inner walls presenting confronting channels respectively, extending vertically upward from the lower ends of said pieces, each of said channels having a front side, a rear side and a bottom side, and a protuberance integrally formed on and near the mid point of each of said rear sides of said channels extending into the associated channel, said protuberances tending to urge a post inserted into said channels toward said front sides of said channels, each of said pieces has two vertically spaced pockets formed in said bottom side of its channel and two vertically spaced pockets formed in its outer wall, in alignment, respectively, with said pockets formed in said bottom side, each of said pockets having a flat bottom with a fastener receiving opening, said flat bottoms of said pockets in said inner walls abutting said flat bottoms of said pockets in said outer walls, respectively, and said openings in abutting pockets being in alignment.

4. The plastic support of claim 3 wherein each of said pockets in said outer walls is sufficiently large to contain the head of a fastener.

5. A plastic support for a plastic mailbox adapted to mount on a square section post set in the ground, comprising:

first and second vertically extending pieces each having vertically extending outer, inner, front and rear walls, said inner walls presenting confronting channels respectively, extending vertically upward from the lower ends of said pieces, each of said channels having a front side, a rear side and a bottom side, each of said outer walls of said pieces has a vertically extending indentation presenting a plurality of vertically extending parallel vertical ribs, and a protuberance integrally formed on and near the mid point of each of said rear sides of said channels extending into the associated channel, said protuberances tending to urge a post inserted into said channels toward said front sides of said channels.

* * * * *